United States Patent [19]

Sprenger et al.

[11] Patent Number: 4,978,248

[45] Date of Patent: Dec. 18, 1990

[54] ADVANCEABLE MINE ROOF SUPPORTS

[75] Inventors: Gerhard Sprenger, Lünen; Jürgen Dodt, Iserlohn, both of Fed. Rep. of Germany

[73] Assignee: Gewerkschaft Eisenhutte Westfalia, GmbH, Fed. Rep. of Germany

[21] Appl. No.: 379,476

[22] Filed: Jul. 13, 1989

[30] Foreign Application Priority Data

Jul. 13, 1988 [DE] Fed. Rep. of Germany ..... 3823682

[51] Int. Cl.[5] ..... E21D 23/08

[52] U.S. Cl. ..... 405/292; 405/291

[58] Field of Search ..... 405/291–296; 403/165; 299/31, 33

[56] References Cited

U.S. PATENT DOCUMENTS

| | | | |
|---|---|---|---|
| 3,064,751 | 11/1962 | Nemecek et al. | 403/165 X |
| 3,915,500 | 10/1975 | Schlusener | 405/296 X |
| 4,045,089 | 8/1977 | Hauschopp et al. | 405/291 X |
| 4,184,791 | 1/1980 | Becker et al. | 405/291 |
| 4,187,042 | 2/1980 | Plevak et al. | 405/291 |
| 4,379,661 | 4/1983 | Wojaczek et al. | 405/291 X |
| 4,449,859 | 5/1984 | Terhorst et al. | 405/291 |
| 4,518,284 | 5/1985 | Becker et al. | 405/296 |

FOREIGN PATENT DOCUMENTS

| | | |
|---|---|---|
| 3317801 | 11/1984 | Fed. Rep. of Germany . |
| 3700692 | 7/1988 | Fed. Rep. of Germany . |
| 2005755 | 4/1979 | United Kingdom . |
| 2152570 | 8/1985 | United Kingdom . |

*Primary Examiner*—Dennis L. Taylor

*Attorney, Agent, or Firm*—Samuels, Gauthier & Stevens

[57] ABSTRACT

A roof support has a pair of floor sills carrying hydraulic props supporting a roof-engaging structure. The floor sills have guide rails on their adjacent sides which mate with a slidable guide block which connects to a shifting ram and thrust mechanism between the sills. The shifting ram has one of its displaceable parts, i.e. its cylinder or piston rod articulated to a thrust beam or a pair of thrust rods which link with a conveyor in front of the support. The sills are interconnected for relative vertical movement and are coupled to the other displaceable part of the ram. The guide is linked to the thrust beam or thrust rods remote from the conveyor by way of a pivot joint which resists traction but permits pivoting about an axis generally parallel to the ram and which is easily assembled and dismounted.

20 Claims, 6 Drawing Sheets

FIG. 4
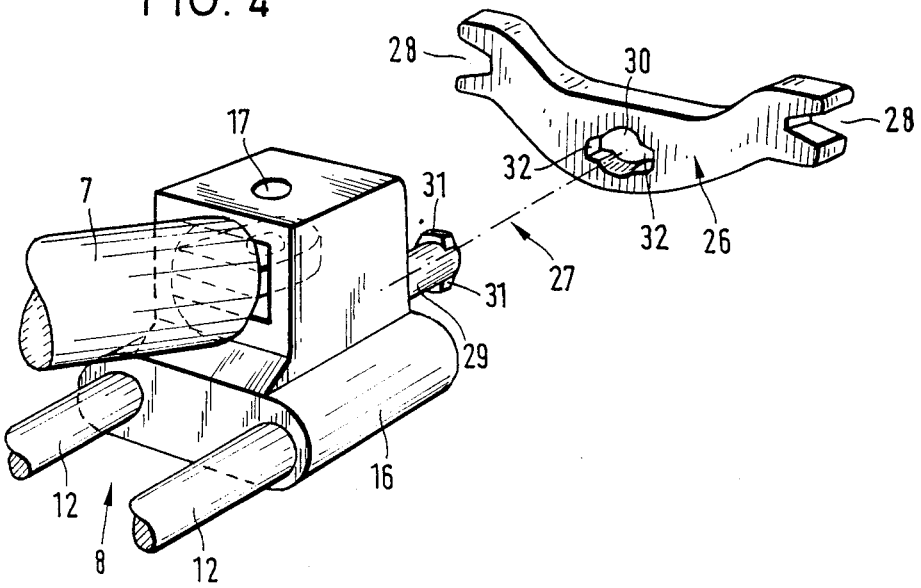
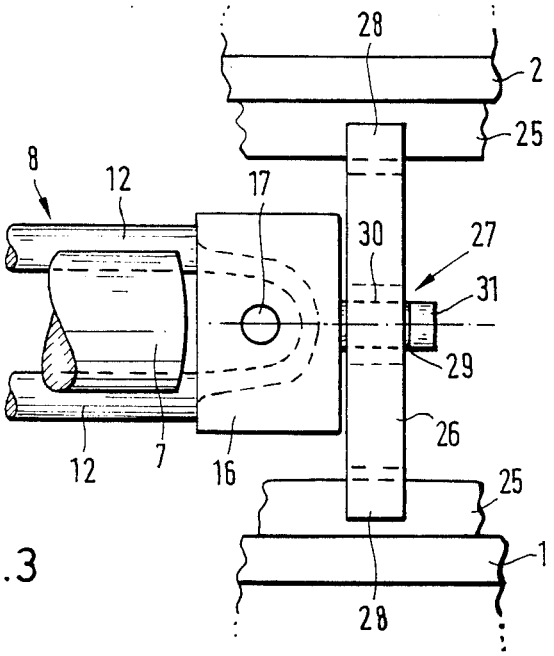
FIG.3

ADVANCEABLE MINE ROOF SUPPORTS

FIELD OF THE INVENTION

The present invention relates to advanceable mine roof supports.

BACKGROUND TO THE INVENTION

Mine roof supports usually employ a number of hydraulic telescopic props disposed between floor and roof engaging structures. To advance the supports behind a conveyor to follow up the winning progress, it is known to sub-divide the floor structure into a pair of skids or sills and to provide a hydraulic shifting ram between the sills. The ram is coupled to the sills on the one hand and to the conveyor on the other hand. By extending and retracting the ram and by bracing or relieving the props as appropriate the conveyor and the support can be advanced in stages towards the mineral face. It is known to link the shifting ram to resilient thrust rods which are guided on the sills to ensure the correct guidance. It is also known to provide a goaf shield between the roof engaging structure and the floor sills.

DE-OS No. 3700692 describes a known powered roof support in which the cylinder of the shifting ram is connected to a slidable guide engaging on guide rails on the floor sills and the piston rod is connected to a cross-piece which interconnects the front regions of the floor sills for relative vertical displacements. A thrust mechanism composed of a pair f resilient rods is coupled to the cylinder of the ram and serves for connection to the advance conveyor. A plate on the upper side of the rods near the front end regions of the floor sills serves to support hydraulic lifting units which serve to partly lift the sills during their advancement. This known support suffers from problems in that the thrust rod mechanism can tilt or position itself obliquely if the sills and the guide rails assume markedly different levels. In this case the guide can become jammed. Furthermore, since the guide is rigidly connected to the thrust rods these can cause the support plate to become inclined across the sills and the lifting units cannot then be supported properly.

DE-OS 3317801 describes another support in which the piston rod of the shifting ram is connected via a guide rod to an advance abutment, i.e. a conveyor. A frame around the ram is connected to the cylinder of the ram and is linked via a joint to a cross-piece connected between the floor sills. A pair of parallel guide rods lie between the frame and are guided in openings in the frame. This guidance system also has certain disadvantages.

An object of the invention is to provide an improved form of advanceable roof support.

SUMMARY OF THE INVENTION

The invention relates to a roof support comprising a floor engaging structure, a roof engaging structure, telescopic props disposed between the roof and floor engaging structures, the floor engaging structure being composed of a pair of laterally-spaced apart floor sills; shifting means at least partly between the sills, the shifting means being composed of an hydraulic ram and thrust means operably connected in an articulated manner to the floor sills and being adapted for connection in an articulated manner to an advance abutment, such as a conveyor, adjacent the support, means interconnecting the floor sills to permit relative vertical displacement therebetween, elongate guides on adjacent sides of the floor sills and a guide connected to the shifting means slidably engaged with the elongate guides; whereby the ram can be operated to extend or retract to displace the support forwardly relative to the advance abutment or to displace the advance abutment away from the support in an advancing direction with the aid of the thrust means and the shifting means is guided by relative displacement between the guide and the guide rails. In accordance with the invention, the guide which slidably engages with the elongate guides on the sides of floor sills is coupled to the shifting means with a pivot joint having an axis extending in the direction of advancement. This simple expedient has great benefits in that proper guidance is preserved and any vertical displacement between the sills does not adversely affect the guidance. Preferably, hydraulic lifting units are used to partly lift the sills when these are shifted. These may rest on a supportive part of the thrust means which now remains in a more or less horizontal disposition. The guide has lateral recesses, such as V-shaped grooves, engaging with guide rails acting as the elongate guides. The guide may have a central opening for receiving a pivot pin defining the pivot joint. To permit easy assembly and disassembly the pivot pin may have one or more projections which act as locking lugs which pass through recesses adjoining the opening in the guide when the guide assumes a certain orientation say 90° to the normal operating position. In this way there is a bayonette-type fitting which resists traction while allowing the desired pivotal movement. In another construction the pivot pin is provided on the guide while the opening is in another component such a connector or coupling on the thrust means.

The thrust means can take the form of a pair of resilient rods extending between upper and lower plates at their front regions. The upper plate then acts to support the lifting units. Alternatively, the thrust means may take the form of a stout floor beam. In the former case, the cylinder of the shifting ram is coupled to the rear ends of the rods while in the latter case the piston rod of the ram is coupled to a forward region of the floor beam. Where the thrust rods are employed the guide is coupled to a connector joining the cylinder of the ram to the rods and the piston rod of the ram engages on a cross-piece extending between the floor sills and engaging in bracket means on the floor sills in a manner to permit said relative vertical displacements. Where the floor beam is employed the cylinder of the ram can be linked to a cross-piece extending between the rear regions of the floor sills and located to permit the said relative vertical displacements while the guide is coupled to the rear of the thrust beam via a connector and the pivot joint.

Conveniently, the thrust rods are disposed with the pivot joint beneath the elongate guides. This guide may then have a yoke-like form with upturned wings engaging with the elongate guide.

The invention may be understood more readily and various other aspects and features of the invention may become apparent from consideration of the following description.

BRIEF DESCRIPTION OF DRAWINGS

Embodiments of the invention will now be described, by way of examples only, with reference to the accompanying drawings, wherein:

FIG. 3 is a detail plan view of the rear end of the thrust rod mechanism of the support shown in FIGS. 1 and 2, the view being taken on a somewhat larger scale than FIGS. 1 and 2;

FIG. 4 is a perspective exploded view of the rear end of the thrust rod mechanism shown in FIG. 3;

DESCRIPTION OF PREFERRED EMBODIMENTS

Figure 9:
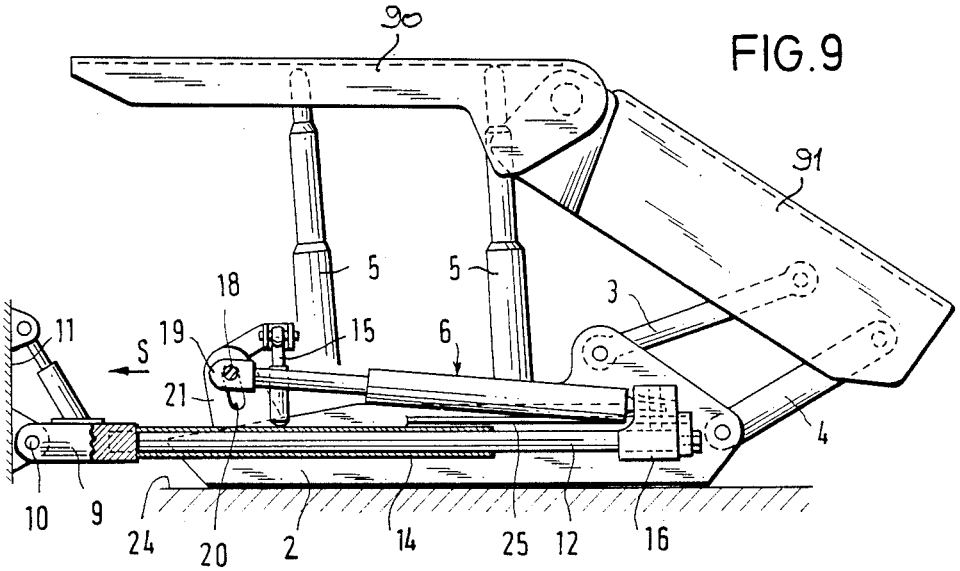
FIG. 9 depicts the mine roof support shown in FIGS. 1 to 4.

In general, as shown in FIG. 9, a mine roof support constructed in accordance with the invention employs a pair of floor-engaging sills 1, 2. Each sill 1, 2 carries one or more telescopic props 5 which in turn carry a single or multi-part roof-engaging structure 90. A goaf shield 91 is pivotably mounted on the roof engaging structure 90 and the shield is then connected via guide levers 3, 4 to the sills 1, 2.

Figure 1:
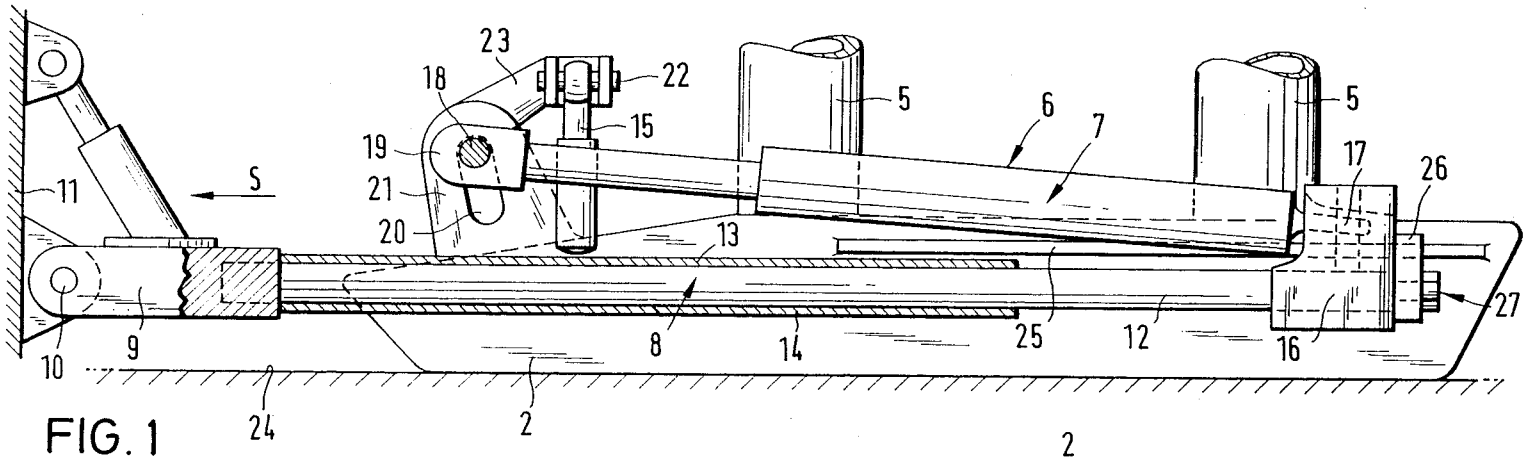
FIG. 1 is a part-sectional side view of the lower region of a support constructed in accordance with the invention.
Figure 2:
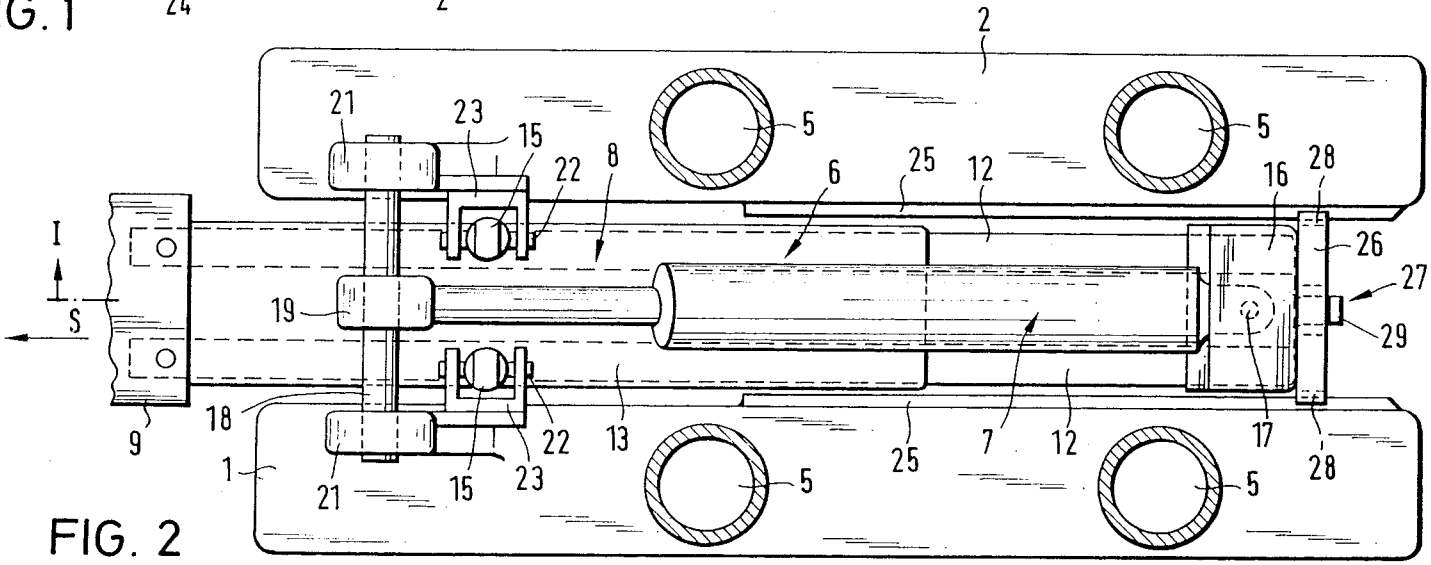
FIG. 2 is a plan view of the lower region of the support shown in FIG. 1.
Figure 5:
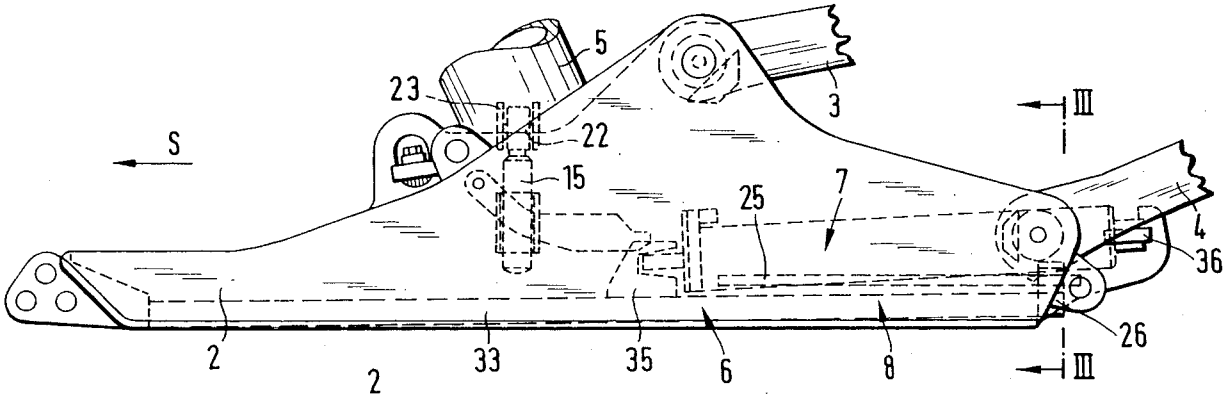
FIG. 5 is a side view of the lower region of another support constructed in accordance with the invention.
Figure 6:
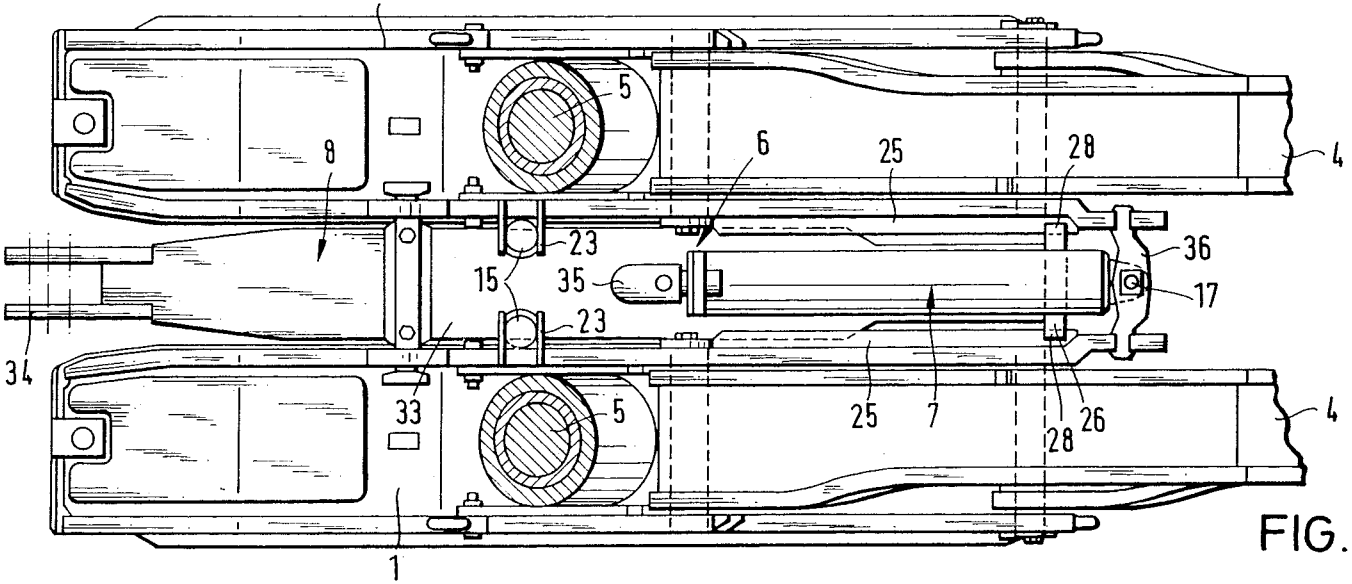
FIG. 6 is a plan view of the lower region of the support shown in FIG. 5.
Figure 7:
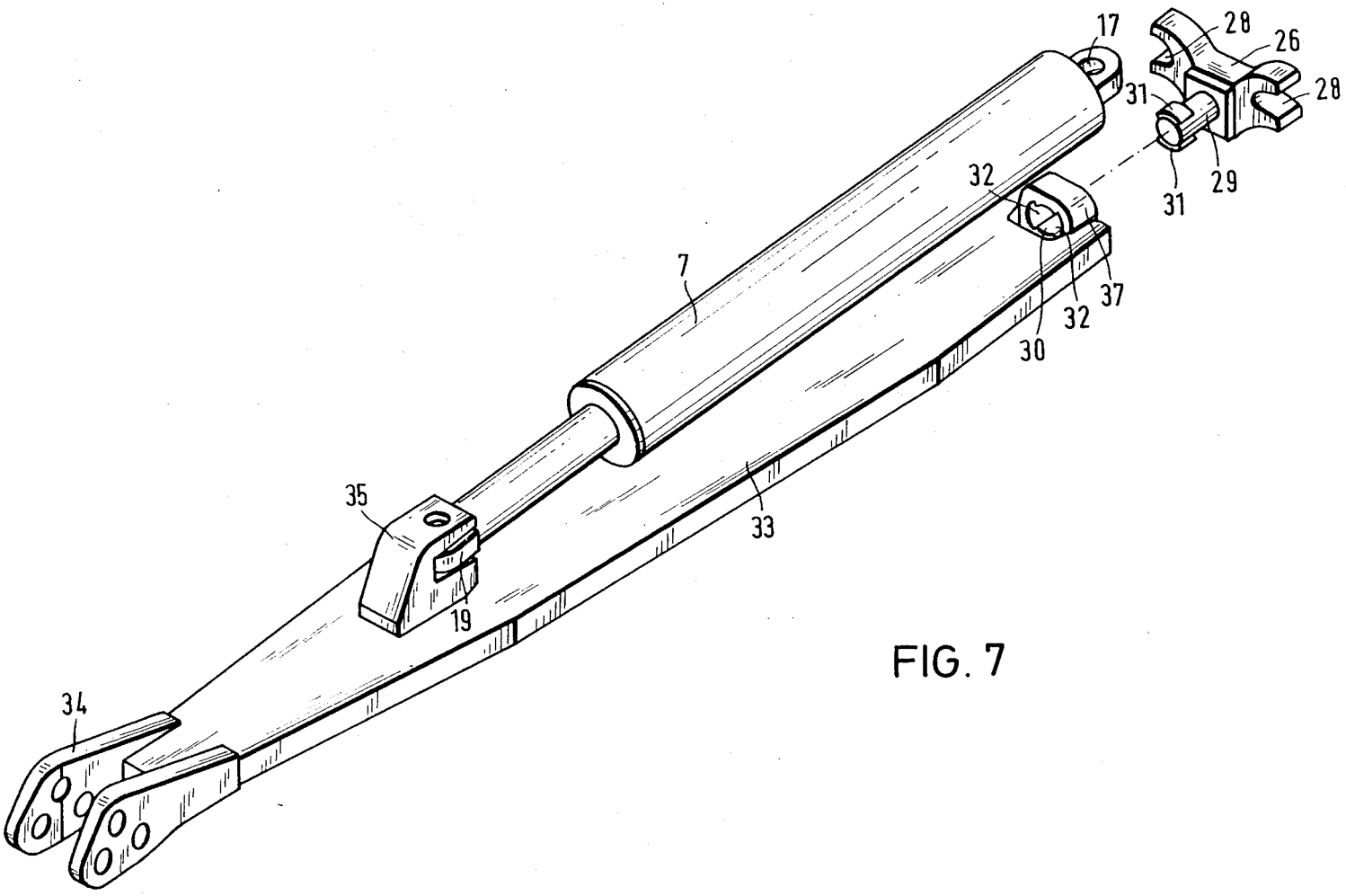
FIG. 7 is a perspective exploded view of the shifting ram and thrust means of the support shown in FIGS. 5 and 6.
Figure 8:
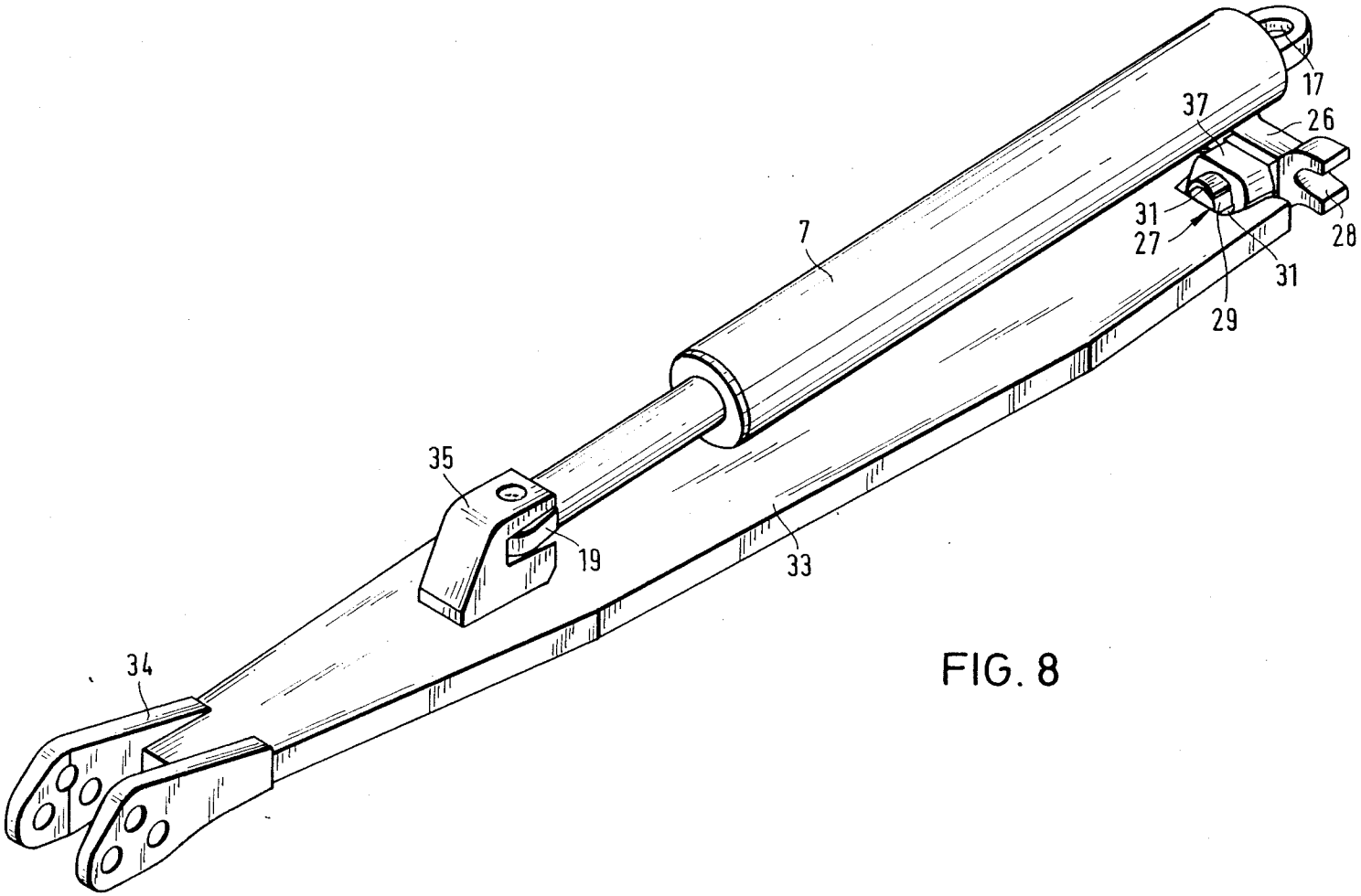
FIG. 8 is a perspective view of the shifting ram and thrust means shown in FIG. 7.

A combined unit 6 serving as a shifting ram and thrust means is disposed between the floor sills 1, 2. As shown in FIGS. 1 to 4, the unit 6 is composed of a double-acting hydraulic ram 7 and a thrust rod mechanism 8. The mechanism 8 employs two parallel resilient rods 12 interconnected at their front ends adjacent a mineral face with a head piece 9. As is known, the head piece 9 is pivotably mounted with a joint 10 to a bracket on a scraper-chain conveyor 11. An hydraulic adjustment device can be provided between the head piece 9 and the conveyor 11 as shown in FIG. 1 to control the inclination of the conveyor 11 and the cutting horizon of a mineral winning machine. The rods 12 extend between upper and lower plates 13, 14 disposed adjacent the head piece 9. The rods 12 are rigidly secured to the plates 13, 14. The upper plate 13 forms an supportive abutment for hydraulic piston and cylinder units 15. The rear ends of the rods 12 remote from the mineral face are connected together with a connector 16. The ram 7 lies over the mechanism 8 and the cylinder of the ram 7 is coupled to the connector 16 with an upstanding pivot joint 17.

The sills 1, 2 are interconnected near their front ends for relative vertical displacement. More particularly, a pair of upstanding brackets 21 are provided on the floor sills 1, 2 and a cross-piece 18 extends between the brackets 21 and slidably engages in slots 20 in the brackets 21. The cross-piece 18 is connected to the piston rod of the ram 7 with the aid of a connector 19.

The units 15 have piston rods connected with joints 22 to U-shaped brackets 23 fixed to the adjacent sides of the sills 1, 2. The units 15 serve to partially lift the sills 1, 2 away from the floor (24 FIG. 1) of the working when the support is being shifted up with the ram 7.

The floor sills 1, 2 have guide rails 25 fitted to their adjacent sides at least at the rear end regions. The unit 6 is guided on the rails 25 in the advancing direction (S FIG. 2) with the aid of a slidable guide 26. The guide 26 is joined to the connector 16 with a pivot or swivel joint 27 with an axis of pivoting orientated parallel to the ram 7 and in the direction of advancement (arrow S). The mechanism 8 is coupled with the pivot joint 27 to the guide 26 in a traction resistant manner but is pivotable about the axis of the joint 27. As shown in FIGS. 3 and 4 the guide 26 takes the form of a yoke which is provided with lateral V-shaped grooves 28 in wings which engage with the guide rails 25. The pivot joint 27 is disposed centrally between the grooves 28 but below the grooves 28. The joint 27 is defined by a pivot pin 29 rigidly fixed to the connector 16. An opening 30 in the guide 26 receives the pin 29.

Conveniently the circular opening 30 has diametrically opposed recesses 32 which receive lugs 31 on the pin 29. During assembly the guide 26 is transposed through 90° relative to its normal horizontal operation position to assume a near vertical disposition. This permits the pin 29 to be pushed through the opening 30 with the lugs 31 passing through the recesses 32. The guide 26 can then be swung through 90° into its normal position so that the lugs 31 grip behind the outer face of the guide 26 to lock the guide 26 in a traction resistant manner to the mechanism 8 while permitting pivoting about the axis of the joint 27.

To advance the conveyer 11 towards the working face in the direction of arrow S the ram 7 is charged with pressure fluid to retract. The mechanism 8 is displaced with the cylinder of the ram 7 and is guided by the movement of the guide 26 on the stationary guide rails 25. The piston rod of the ram 7 is fixed to the sills 1, 2 which are braced by the props 5 firmly set between the floor and the roof. Since the guide 26 is able to swivel relative to the mechanism 8, the sills 1, 2 can adjust themselves to different heights without adversely affecting the mechanism 8 and its guide means. In general, the mechanism 8 adopts a position substantially parallel to the floor as does the plate 13 on which the lifting units 15 rest. When the support is to be shifted to follow the conveyor 11 the props are relieved and the ram 7 is charged with pressure fluid to extend. The cylinder and the mechanism 8 now remain fixed while the piston rod extends to force the sills 1, 2 forward. In this phase, the sills 1, 2 are guided by their moving guide rails 25 on the stationary guide 26. To assist in the shifting of the support the units 15 are at least partly extended to lift the sills 1, 2 to some extent.

FIGS. 5 to 8 depict another embodiment of the invention in which like reference numerals denote like parts to FIGS. 1 to 4. In the construction represented in FIGS. 5 to 8, the pivot joint 27 takes a different form and is composed of a pivot pin 29 on the guide 26 which fits into an opening 30 in a fitting 37. To assemble the joint 27, the pin 29 and the guide 26 is moved through 90° relative to the position shown in FIG. 7. The pin 29 can then be fitted in the opening 30 with the lugs 31 passing through the recess 32. The guide 26 is then transposed into the position shown in FIG. 8. As with the first embodiment the swivel joint 27 is located beneath the guide rails 25 with the grooves 28 of the guide 26 above the swivel joint 27. The ram 7 is reversed in relation to the first embodiment with the piston rod coupled to thrust means to the conveyor and the cylinder coupled to the floor sills. The thrust means 8 is also modified and in the construction shown in FIGS. 5 to 8 the thrust means 8 takes the form of a floor beam 33 with a front mounting structure 34 for fixing to the conveyor. The piston rod of the ram 7 is articulated to the beam 33 with the aid of a bracket 35 and a connector 19. The lifting units 15 extend either side of the ram 7 to rest on the beam 33 and the fitting 37 for the pivot joint 27 is provided in a recess in the rear end of the beam 33.

The sills 1, 2 are permitted to move relatively to one another in a vertical sense in the goaf end regions. This is accomplished by a cross-piece 36 corresponding to the cross piece 18 in the first embodiment. The cylinder of the ram 7 is connected to the cross-piece 36 with a pivot joint 17.

To advance the conveyor 11, the ram 7 is charged with pressure fluid to extend and the piston rod is displaced to thrust the beam 33 forwards in the direction of arrow S. The beam 33 is guided as it moves by the guide 26 moving along the guide rails 25 of the sills 1, 2. When the support is to be shifted up, the props 5 are at least partly relieved and the ram 7 is charged with pressure fluid to retract. The units 15 can partly lift the sills 1, 2 which move with the cylinder of the ram 7 relative to the fixed piston rod and beam 33. The guide rails 25 of the sills 1, 2 move along the stationary guide 26.

We claim:

1. In an advanceable roof support comprising a floor engaging structure, a roof engaging structure, telescopic props disposed between the roof and floor engaging structures, the floor engaging structure being composed of a pair of laterally-spaced apart floor sills; shifting means at least partly between the sills, the shifting means being composed of an hydraulic ram and thrust means operably connected in an articulated manner to the floor sills and being adapted for connection in an articulated manner to an advance abutment, such as a conveyor, adjacent the support, means interconnecting the floor sills to permit relative vertical displacement therebetween, elongate guides on adjacent sides of the floor sills and a guide connected to the shifting means slidably engaged with the elongate guides whereby the ram can be operated to extend or retract to displace the support forwardly relative to the advance abutment or to displace the advance abutment away from the support in an advancing direction with the aid of the thrust means and the shifting means is guided by relative displacement between the guide and the guide rails; the improvement comprising the guide is connected to the shifting means by a pivot joint with an axis extending in the direction of advancement, and further comprising hydraulic piston and cylinder units coupled to the floor sills and resting on a supportive face of the thrust means, the units being used to partially lift the floor sills during the advancing displacement of the support.

2. A roof support according to claim 1, wherein the thrust means incorporates a pair of resilient thrust rods.

3. A roof support according to claim 1, wherein the thrust means comprises a floor beam.

4. A roof support according to claim 1, wherein the elongate guides are guide rails and the guide has grooves in lateral side faces which receive the guide rails.

5. A roof support according to claim 1, wherein the pivot joint for the guide comprises a pivot pin fixed to the guide and engaging in an opening in a component of the shifting means.

6. A roof support according to claim 1, wherein the pivot joint for the guide takes the form of a pivot pin fixed to a component of the shifting means and engaging in an opening in the guide.

7. A roof support according to claim 5, wherein the opening has a circular portion adjoining one or more radial recesses and the pivot pin has one or more locking lugs which pass through the recess or recesses when the pin is in a certain orientation to permit assembly of the pivot joint.

8. A roof support according to claim 6, wherein the opening has a circular portion adjoining one or more radial recesses and the pivot pin has one or more locking lugs which pass through the recess or recesses when the pin is in a certain orientation to permit assembly of the pivot joint.

9. A roof support according to claim 5, wherein the pivot pin engages in the opening in a manner to permit relative pivotal movements but to resist traction between the guide and the shifting means.

10. A roof support according to claim 6, wherein the pivot pin engages in the opening in a manner to permit relative pivotal movements but to resist traction between the guide and the shifting means.

11. A roof support according to claim 2, wherein the ram has its cylinder fitted to a connector interconnecting the rear ends of the thrust rods relative to the direction of advancement, the guide is coupled to the connector via the pivot joint and the ram has a piston rod engaging on a cross-piece extending between the floor sills and engaging in bracket means on the floor sills in a manner to permit said relative vertical displacements.

12. A roof support according to claim 3, wherein the ram has a cylinder fitted to a cross-piece extending between the floor sills and located in a manner to permit said relative vertical displacements, the guide is coupled to the thrust beam via the pivot joint and the ram has a piston rod coupled to the thrust beam.

13. A roof support according to claim 2, wherein the thrust rods extend partly between upper and lower plates remote from the guide and hydraulic piston and cylinder units are provided to partly lift the floor sills when the support is to be advanced wherein the units rest on the upper plates and are coupled to the floor sills.

14. A roof support according to claim 12, wherein the pivot joint has a pivot pin fitted to the guide engaging in an opening in a connector provided at the end of the thrust beam remote from the advance abutment.

15. A roof support according to claim 1, wherein the thrust means is a thrust rod mechanism which is disposed together with the pivot joint beneath the elongate guides.

16. A roof support according to claim 3, wherein hydraulic piston and cylinder units rest on the thrust beam and are coupled to the floor sills, said units serving to partially lift the floor sills when the support is to be advanced.

17. In an advanceable roof support comprising a floor engaging structure, a roof engaging structure, telescopic props disposed between the roof and floor engaging structures, the floor engaging structure being composed of a pair of laterally-spaced apart floor sills; shifting means at least partly between the sills, the shifting means being composed of an hydraulic ram and thrust means operably connected in an articulated manner to the floor sills and being adapted for connection in an articulated manner to an advance abutment, such as a conveyor, adjacent the support, means interconnecting the floor sills to permit relative vertical displacement therebetween, elongate guides on adjacent sides of the floor sills and a guide connected to the shifting means slidably engaged with the elongate guides whereby the ram can be operated to extend or retract to displace the support forwardly relative to the advance abutment or to displace the advance abutment away from the support in an advancing direction with the aid of the thrust means and the shifting means is guided by relative displacement between the guide and the guide rails; the improvement comprising the guide is connected to the shifting means by a pivot joint with an axis extending in the direction of advancement, said pivot joint including a pivot pin fixed to the guide and engaging in an opening in a component of the shifting means, said opening having a circular portion adjoining one or more radial recesses, and the pivot pin having one or more locking lugs which pass through the recess or recesses when the pin is in a certain orientation to permit assembly of the pivot joint.

18. In an advanceable roof support comprising a floor engaging structure, a roof engaging structure, telescopic props disposed between the roof and floor engaging structures, the floor engaging structure being composed of a pair of laterally-spaced apart floor sills; shifting means at least partly between the sills, the shifting means being composed of an hydraulic ram and thrust means operably connected in an articulated manner to the floor sills and being adapted for connection in an articulated manner to an advance abutment, such as a conveyor, adjacent the support, means interconnecting the floor sills to permit relative vertical displacement therebetween, elongate guides on adjacent sides of the floor sills and a guide connected to the shifting means slidably engaged with the elongate guides whereby the ram can be operated to extend or retract to displace the support forwardly relative to the advance abutment or to displace the advance abutment away from the support in an advancing direction with the aid of the thrust means and the shifting means is guided by relative displacement between the guide and the guide rails; the improvement comprising the guide is connected to the shifting means by a pivot joint with an axis extending in the direction of advancement, said pivot joint including a pivot pin fixed to a component of the shifting means and engaging in an opening in the guide, said opening having a circular portion adjoining one or more radial recesses, and the pivot pin have one or more locking lugs which pass through the recess or recesses when the pin is in a certain orientation to permit assembly of the pivot joint.

19. In an advancement roof support comprising a floor engaging structure, a roof engaging structure, telescopic props disposed between the roof and floor engaging structures, the floor engaging structure being composed of a pair of laterally-spaced apart floor sills; shifting means at least partly between the sills, the shifting means being composed of an hydraulic ram and thrust means operably connected in an articulated manner to the floor sills and being adapted for connection in an articulated manner to an advance abutment, such as a conveyor, adjacent the support, means interconnecting the floor sills to permit relative vertical displacement therebetween, elongate guides on adjacent sides of the floor sills and a guide connected to the shifting means slidably engaged with the elongate guides whereby the ram can be operated to extend or retract to displace the support forwardly relative to the advance abutment or to displace the advance abutment away from the support in an advancing direction with the aid of the thrust means and the shifting means is guided by relative displacement between the guide and the guide rails; the improvement comprising the guide is connected to the shifting means by a pivot joint with an axis extending in the direction of advancement, and the thrust means incorporates a pair of resilient thrust rods extending partly between upper and lower plates remote from the guide, and hydraulic piston and cylinder units are provided to partly lift the floor sills when the support is to be advanced wherein the units rest on the upper plates and are coupled to the floor sills.

20. In an advanceable roof support comprising a floor engaging structure, a roof engaging structure, telescopic props disposed between the roof and floor engaging structures, the floor engaging structure being composed of a pair of laterally-spaced apart floor sills; shifting means at least partly between the sills, the shifting means being composed of an hydraulic ram and thrust means operably connected in an articulated manner to the floor sills and being adapted for connection in an articulated manner to an advance abutment, such as a conveyor, adjacent the support, means interconnecting the floor sills to permit relative vertical displacement therebetween, elongate guides on adjacent sides of the floor sills and a guide connected to the shifting means slidably engaged with the elongate guides whereby the ram can be operated to extend or retract to displace the support forwardly relative to the advance abutment or to displace the advance abutment away from the support in an advancing direction with the aid of the thrust means and the shifting means is guided by relative displacement between the guide and the guide rails; the improvement comprising the guide is connected to the shifting means by a pivot joint with an axis extending in the direction of advancement, the thrust means takes the form of a floor beam, and hydraulic piston and cylinder units rest on said beam and are coupled to the floor sills, said units serving to partially lift the floor sills when the support is to be advanced.

* * * * *